United States Patent [19]

Ueda

[11] 4,086,755

[45] May 2, 1978

[54] APPARATUS FOR CORRECTING SECOND HAND OF ELECTRONIC TIMEPIECE

[75] Inventor: Takashi Ueda, Tokyo, Japan

[73] Assignee: Kabushiki Kaisha Daini Seikosha, Japan

[21] Appl. No.: 631,624

[22] Filed: Nov. 13, 1975

[30] Foreign Application Priority Data

Nov. 14, 1974 Japan ..... 49-131408[U]

[51] Int. Cl.[2] ..... G04B 27/08

[52] U.S. Cl. ..... 58/85.5; 58/23 R; 58/50 R

[58] Field of Search ..... 58/23 R, 50 R, 85.5

[56] References Cited

U.S. PATENT DOCUMENTS

| | | | |
|---|---|---|---|
| 3,668,859 | 6/1972 | Polin et al. | 58/85.5 X |
| 3,823,545 | 7/1974 | Vittoz et al. | 58/85.5 X |
| 3,834,152 | 9/1974 | Nishimura et al. | 58/85.5 X |
| 3,895,486 | 7/1975 | Hammer et al. | 58/23 R |
| 3,931,703 | 1/1976 | Scherrer et al. | 58/85.5 X |
| 3,948,035 | 4/1976 | Kusumoto | 58/23 R |

*Primary Examiner*—Ulysses Weldon

*Attorney, Agent, or Firm*—Robert E. Burns; Emmanuel J. Lobato; Bruce L. Adams

[57] ABSTRACT

An electronic timepiece comprises an oscillator which generates high frequency pulses, a dividing circuit connected to receive the high frequency pulses from the oscillator and divide them into lower frequency pulses suitable for use as a time standard, and a time indicator responsive to the lower frequency pulses for indicating the time in at least minutes and seconds. An apparatus for correcting the seconds indication of the time indicator comprises a delaying circuit connected to receive lower frequency pulses from the dividing circuit and delay them a predetermined time period, and a selecting circuit connected to receive both the lower frequency pulses and the delayed pulses and selectively pass them to the time indicator in response to control signals. An advance-set circuit is connected to an advancing switch and responds to each switch actuation to transmit an advance control signal to the selecting circuit which then adds a lower frequency pulse to a delayed pulse to thereby advance the seconds indication, and a retard-set circuit is connected to a retarding switch and responds to each switch actuation to transmit a retard control signal to the selecting circuit which then inhibits the passing of a lower frequency pulse to thereby retard the seconds indication. An up-down counter coacts with an advance-reset circuit and a retard-reset circuit for counting the number of actuations of the advancing and retarding switches and effecting resetting of corresponding ones of the advance-set and retard-set circuits.

5 Claims, 4 Drawing Figures

APPARATUS FOR CORRECTING SECOND HAND OF ELECTRONIC TIMEPIECE

BACKGROUND OF THE INVENTION

This invention relates to an electronic timepiece having apparatus for correcting a second hand and more particularly to an electronic timepiece having apparatus for correcting a second hand in dependence on the number of actuations of a switch means for the second hand correction.

Conventionally, in apparatus of this type for use in an electronic timepiece, when an adjustment of 5 seconds is to be made, the operator must close the switch for second-correction during 5 minutes or he must operate the switch for second-correction 5 times at one second intervals.

SUMMARY OF THE INVENTION

This invention relates to apparatus for correcting the second hand of the electronic timepiece in dependence on the number of actuations of a switch. The electronic timepiece comprises a quartz-oscillator, a driving circuit and a converter for effecting driving of the second hand. The apparatus for correcting the second hand comprises an advance-set circuit and a retard-set circuit, switch means and a counter operative to make said second hand advance or retard in accordance with the number of actuations of said switch means.

The object of this invention is to provide an electronic timepiece having apparatus for correcting the second hand and which eliminates the above-mentioned defect.

Another object of this invention is to provide an electronic timepiece having apparatus for correcting the second hand by actuating a switch for second-correction at appropriate times in according to a broadcast time announcement.

A further object of this invention is to provide an electronic timepiece having apparatus for correcting the second hand and which is easy to operate.

BRIEF DESCRIPTION OF DRAWINGS

These and other objects, advantages features, and uses will become more apparent as the description proceeds, when considered with the accompanying drawings in which.

Figure 1:
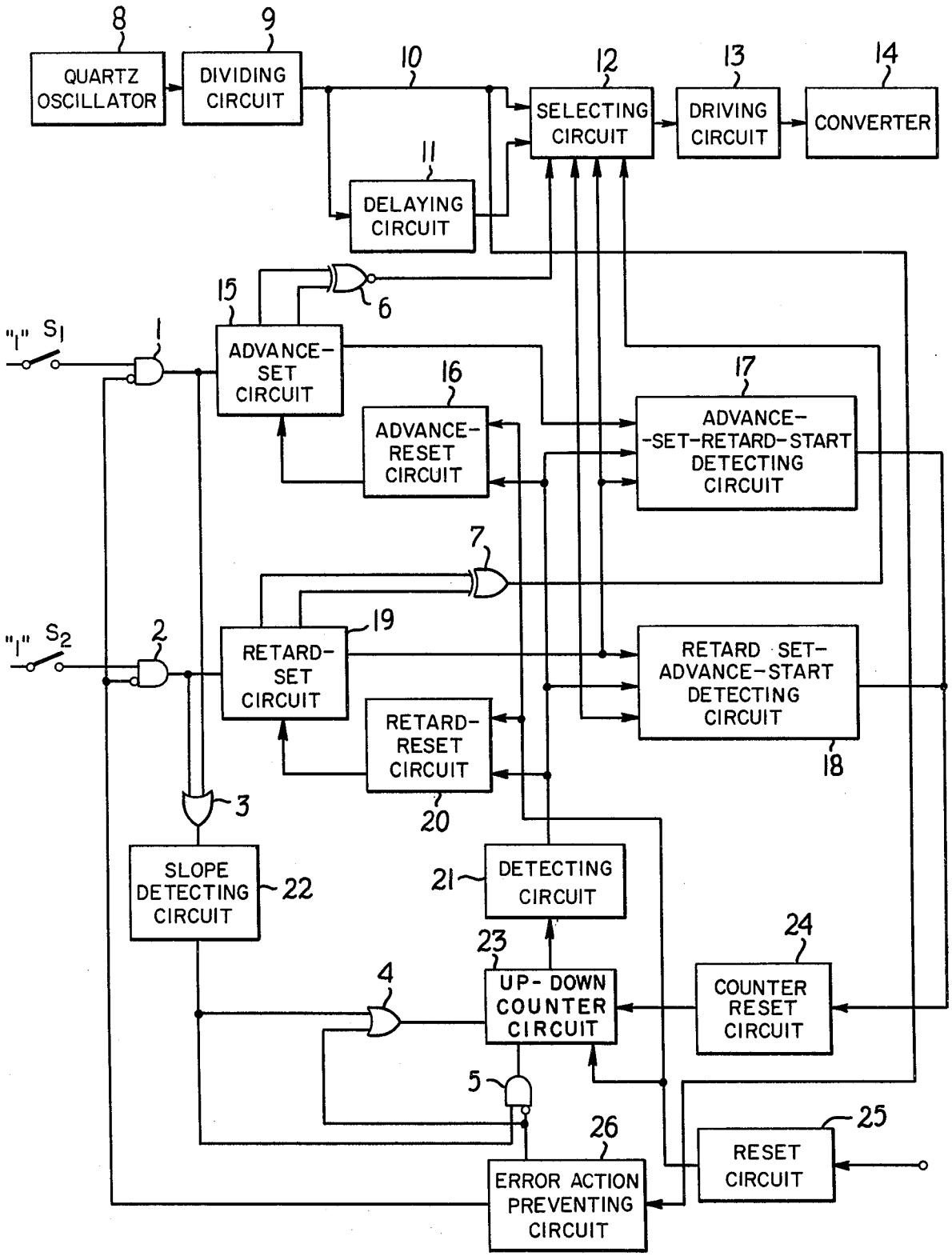
FIG. 1 is a block diagram of an electronic timepiece having apparatus for correcting the second hand embodying this invention.

FIG. (2*b*) shows waveform of the relation between the output of the switch and the output of the driving circuit for the converter shown in the block diagram of FIG. 1.

Figure 3:
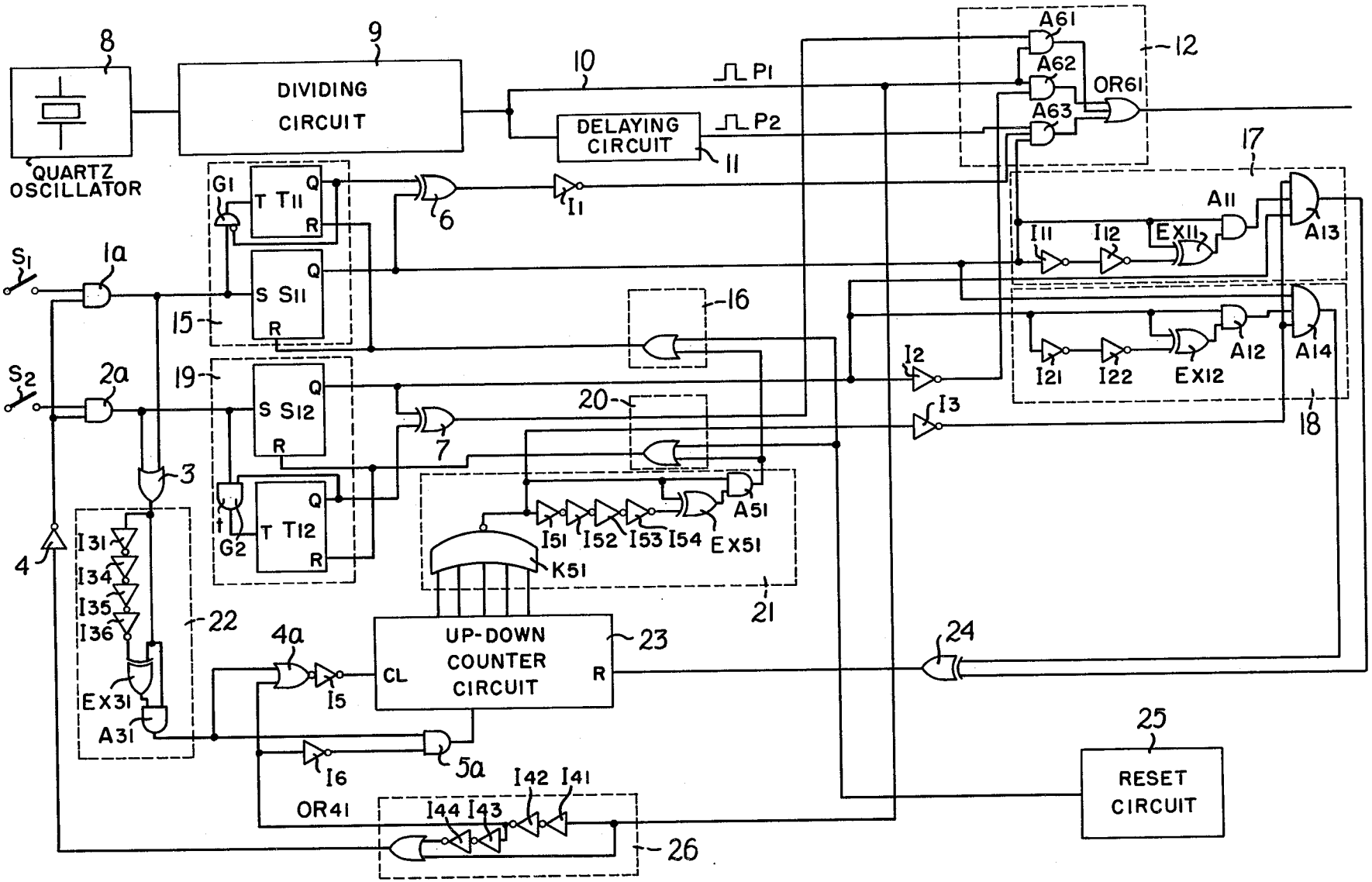

FIG. 3 is a circuit diagram of the components shown in the block diagram of FIG. 1.

DETAILED DESCRIPTION OF THE INVENTION

Referring now to the drawings, FIG. 1 shows a block diagram of an electronic timepiece having apparatus for correcting the timepiece second hand.

The apparatus for effecting the second correction comprises a quartz-oscillator 8 for generating a high frequency output signal, a dividing circuit 9 which divides the high frequency signal (32,768Hz) of said quartz-oscillator 8 to a lower frequency signal of 1Hz and a delaying circuit 11 for delaying the output pulse of said dividing circuit 9 delay by the predetermined time.

A converter 14 (for example, a stepping motor) is connected to be driven by the output signal of a driving circuit 13 connected to a selecting circuit 12 which receives the undelayed output signal of the dividing circuit 9 and the output signal of the delaying circuit 11.

Means for controlling said selecting circuit 12 comprises a second advancing circuit having an advance-set circuit 15 and an advance-reset circuit 16, and a second retarding circuit having a retard-set circuit 19 and a retard-reset circuit 20.

The apparatus for making the second correction includes a second advancing switch $S_1$, a second retarding switch $S_2$, an up-down counter 23 which counts the number of times of operation of said second advancing switch $S_1$ and said second retarding switch $S_2$, a detecting circuit 21 which detects the content of said up-down counter 23, an advance-set-retard-start detecting circuit 17 and a retard-set-advance-start detecting circuit 18.

A counter reset circuit 24 which resets said up-down counter 23 in response to output signals said advance-set-retard-start detecting circuit 17 and said retard-set-advance-start detecting circuit 18.

Next, the operation of this embodiment will be described with reference to FIG. 2 and FIG. 3. In case it is desired to make a one-second advance of the second hand, input terminals of both trigger-flip-flop $T_{11}$ and set-reset flip-flop $S_{11}$ receive the input signal by the closing of the switch $S_1$ whereby the output signal of logic level "1" appears at the output terminal Q of the trigger-flip-flop $T_{11}$ and the output signal of logic level "1" is applied through exclusive or circuit 6 and inverter $I_1$ to the input terminal of AND gate circuit A63. Also, the pulse delaying circuit 11 applies the delayed 1 Hz signal to the AND gate circuit AG3 and through OR-gate circuit OR61 to the driving circuit 13 for driving the stepping motor.

When time-correction is not made (when the apparatus for correcting the second hand is in the normal operational condition), OR-gate OR61 passes the 1Hz-output pulses of the dividing circuit 9 since AND gate A62 included in the selecting circuit 12 receives the signal of logic level "1" through the output terminal Q of the set-reset flip-flop $S_{12}$ from inverter $I_2$.

Figure 2A:
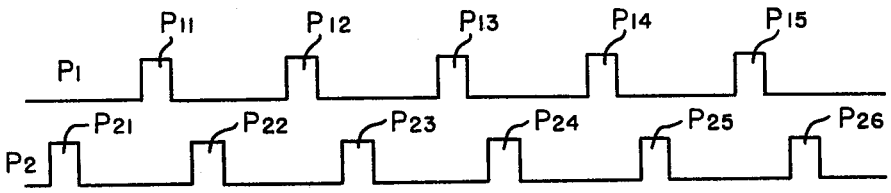
FIG. 2(*a*) show waveform of the relation between the output of the dividing circuit and the output of the delaying circuit.
Figure 2B:
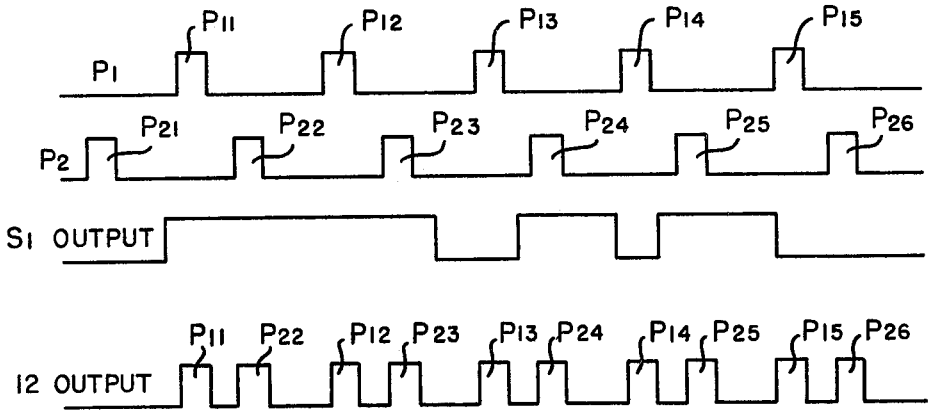

FIG. 2(*a*) shows an output pulse $P_1$ of the dividing circuit 9 and an output pulse $P_2$ of the delaying circuit 11.

When the operator closes or actuates the second-advancing switch $S_1$ one time, the output pulse $P_1$ of the dividing circuit 9 and the delayed output pulse $P_2$ of the delaying circuit 11 are selected and passed by selecting circuit 12.

On the other hand, the input terminal CL of the up-down counter 23 receives the signal of logic level "1" through AND gate 1*a*, OR gate 3, slope-detecting circuit 22, NOR gate 4*a* and inverter $I_5$ from the voltage source by the closing of the switch $S_1$.

The up-down counter 23 counts up 1 when it receives an up-command. Next, when the output pulse $P_1$ of the dividing circuit 9 shown in FIG. 2(*a*) arrives at error action preventing circuit 26, the output pulse $P_1$ is detected whereby the up-down counter 23 receives a down-command and the up-down counter 23 counts down 1 so that the count content becomes 0.

The detecting circuit 21 which detects the content of the up-down counter 23 including NOR gate K51, inverters I51 – I54, exculsive OR Ex51, and AND gate A51 becomes to operating condition whereby the advance-reset circuit 16 operates in order to reset the trigger-flip-flop $T_{11}$ and the set-reset flip-flop $S_{11}$ in the advance-set circuit 15.

After this reset action, logic level "0" is produced at the output terminal Q of the set-reset flip-flop $S_{11}$ whereby the AND gate A63 closes.

Accordingly, after this reset action, the delayed pulse $P_2$ produced by the delaying circuit 11 is inhibited and only the output pulse $P_1$ of the dividing circuit 9 is applied to the driving circuit 13 for driving the converter 14 (the stepping motor) so that the driving circuit 13 becomes to be the normal operational condition.

Next, in case it is desired to make a one-second retardation of the second hand, the switch $S_2$ is closed, and output terminals Q of both trigger-flip-flop $T_{12}$ and set-reset flip-flop $S_{12}$ change to logic level "1". The output of inverter $I_2$ shifts to logic level "0" whereby AND gate A62 closes and inhibits the application of the output pulse $P_1$ of dividing circuit 9 to the driving circuit 13.

On the other hand, when the second-retarding switch $S_2$ is closed one time, the up-down counter 23 receives an up-command and simultaneously counts the pulse applied at input terminal CL of the up-down counter 23 whereby the content value of the up-down counter 23 comes to counting number 1.

Next, when the output pulse $P_1$ is produced from dividing circuit 9, the error-action preventing circuit 26 detects its rising signal wherby the detected signal closes AND gate circuit *2a* through inverter I4 and simultaneously supplies the down-command to up-down counter 23 so that counting value of up-down counter 23 is changed to "0". Detecting circuit 21 detects the count condition of the up-down counter 23 and the retard-reset circuit 20 is actuated by this detected signal whereby the trigger-flip-flop $T_{12}$ and the reset-set flip-flop $S_{12}$ included in the retard-set circuit 19 are reset. As a result, the second hand retards 1 second because of inhibiting one output pulse $P_1$ by means of the selecting circuit 12.

Now, the instantaneous adjustment of the second hand, for example, for making a two-second advancing adjustment will be described. The second advancing switch $S_1$ is closed at first time whereby the outputs of the trigger flip-flop $T_{11}$ and the set-reset flip-flop S11 change to logic level "1" so that AND gate A63 opens.

Next, the advancing switch $S_1$ is closed again, the output of the trigger-flip-flop $T_{11}$ remains logic level "1" since the input terminal of the trigger-flip-flop $T_{11}$ does not receive the signal pulse of the second advancing switch $S_1$ through the inhibiting gate.

Also, AND gate A63 of the selecting circuit 12 is in the gating-state since the output of the set-reset flip-flop $S_1$ is at logic level "1".

At this time, the counting value of the up-down counter 23 is 2. The error preventing circuit 26 changes the counting value of the up-down counter 23 into 1 when the output pulse $P_1$ is produced from the dividing circuit 9.

The output pulse $P_2$ of the delaying circuit 11 is produced with a delay predetermined time after the output pulse $P_1$.

When the output pulse $P_1$ is produced from the dividing circuit 9, the error-preventing circuit 26 detects the output pulse $P_1$ and changes the counting value of the up-down counter 23 from 1 to 0.

Therefore, the detecting circuit 21 operates and the trigger-flip-flop $T_{11}$ and the set-reset flip-flop $S_{11}$ included in the advance-set circuit 15 are reset.

However, before the advance-set circuit 15 is reset, the output pulse $P_2$ of the delaying circuit passes through the selecting circuit 12.

In this manner, the second hand is advanced a number of increments equal to the number of actuations of the second advancing switch $S_1$.

In the state of advancing the second hand, the output of the set-reset flip-flop $S_{12}$ of the retard-set circuit 19 is at logic level "0" whereby AND gate $A_{13}$ of the advancing-set-retarding-start detecting circuit 17 closes.

However, in the above state, the output of the set-reset flip-flop $S_{12}$ of the retarding-set circuit 19 changes to logic level "1" whereby AND gate $A_{13}$ produces the pulse and the up-down counter 23 is reset when the second retarding switch $S_2$ is closed.

The trigger-flip-flop $T_{11}$ and the set-reset flip-flop $S_{11}$ of the advance-set circuit 15 and the retard-set circuit 19 are likewise reset by the above reset.

Accordingly, the second hand acts on the normal operation. As mentioned above, in accordance with this invention, the operator is able to retard and advance the second hand only in response to the number of actuations or operational times of the ON-OFF switch.

Further, the adjustment of the second hand is possible, even if the operator continues to depress or maintains closed the ON-OFF switch so that the time is corrected irrespective of the duration of the switch actuations or the time interval between actuations.

Still further, in the state advancing the second hand, the operator is able to retard the second hand, even if he operates the ON-OFF switch retarding the second hand.

Of course, as it is possible to act the reverse operation also, a variety of time correction is operated.

This invention is similarly applicable with electronic displays wherein the second hand is replaced by a dot display composed of light emitting diodes.

Also, ON-OFF switches $S_1$ and $S_2$ may comprise a single ON-OFF switch so that either the advance-set circuit 15 or the retard-set circuit 19 is selected by the duration of closing of the single ON-OFF switch.

What is claimed is:

1. In an electronic timepiece of the type having an oscillator for generating high frequency pulses; a dividing circuit connected to receive the high frequency pulses from said oscillator and divide them into lower frequency pulses suitable for use as a time standard; and indicating means responsive to the lower frequency pulses for indicating the time in at least minutes and seconds; an apparatus for correcting the seconds indication of said indicating means comprising a delaying circuit connected to receive lower frequency pulses from said dividing circuit and delay them a predetermined time period, a selecting circuit connected to receive the lower frequency pulses from said dividing circuit and connected to receive the delayed lower frequency pulses from said delaying circuit and operative in response to control signals applied thereto to selectively pass the pulses to said indicating means, resettable second advancing means operative when actuated to develop an advance control signal and apply it to said selecting circuit whereby said selecting circuit adds a lower frequency pulse to a delayed lower frequency pulse to thereby advance the seconds indication, resettable second retarding means operative when actuated to develop a retard control signal and apply it to said selecting circuit whereby said selecting circuit inhibits the passing of a lower frequency pulse to thereby retard the seconds indication, actuating means for selectively actuating said second advancing means and said second retarding means to thereby accordingly correct the seconds indication of said indicating means, said actuating means including a manually actuatable advancing switch connected to said second advancing means and operative to effect an advance of the seconds indication by one second in response to each switch actuation irrespective of the duration of the switch actuations, and a manually actuatable retarding switch connected to said second retarding means and operative to effect a retard of the seconds indication by one second in response to each switch actuation irrespective of the duration of the switch actuations, and counting means for counting the number of actuations of said advancing and retarding switches and effecting resetting of corresponding ones of said second advancing means and second retarding means upon correction of the seconds indication as determined by the number of switch actuations.

2. An electronic timepiece according to claim 1; wherein said counting means comprises an up-down counter.

3. An electronic timepiece according to claim 1; wherein said resettable second advancing means comprises an advance-set circuit connected to said advancing switch and responsive to each switch actuation to transmit an advance control signal to said selecting circuit, and means including an advance-reset circuit for resetting said advance-set circuit, and wherein said resettable second retarding means comprises a retard-set circuit connected to said retarding switch and responsive to each switch actuation to transmit a retard control signal to said selecting circuit, and means including a retard-reset circuit for resetting said retard-set circuit.

4. An electronic timepiece according to claim 3; wherein said counting means includes means coacting with said advance-reset circuit and said retard-reset circuit for counting the number of actuations of said advancing and retarding switches and effecting resetting of corrresponding ones of said advance-set and retard-set circuits.

5. An electronic timepiece according to claim 4; wherein said counting means comprises an up-down counter.

* * * * *